US008099987B2

(12) United States Patent
Velicanin

(10) Patent No.: US 8,099,987 B2
(45) Date of Patent: Jan. 24, 2012

(54) LOCKING DEVICE FOR FUNCTIONS WHICH CAN BE CARRIED OUT IN PARTICULAR ON VEHICLES

(75) Inventor: Mensur Velicanin, Velbert (DE)

(73) Assignee: Huf Hülsbeck & Fürst GmbH & Co. KG, Velbert (DE)

( * ) Notice: Subject to any disclaimer, the term of this patent is extended or adjusted under 35 U.S.C. 154(b) by 752 days.

(21) Appl. No.: 12/087,939

(22) PCT Filed: Nov. 17, 2006

(86) PCT No.: PCT/EP2006/011039
§ 371 (c)(1),
(2), (4) Date: Jul. 17, 2008

(87) PCT Pub. No.: WO2007/082569
PCT Pub. Date: Jul. 26, 2007

(65) Prior Publication Data

US 2010/0095721 A1 Apr. 22, 2010

(30) Foreign Application Priority Data

Jan. 18, 2006 (DE) ..... 10 2006 002 538

(51) Int. Cl.
*E05B 17/04* (2006.01)

(52) U.S. Cl. ..... 70/379 R; 70/222; 70/422

(58) Field of Classification Search ..... 70/379 R, 70/379 A, 380, 492, DIG. 52, DIG. 53, DIG. 54, 70/DIG. 55, DIG. 74, 218, 222, 422; 292/DIG. 61
See application file for complete search history.

(56) References Cited

U.S. PATENT DOCUMENTS

| | | | | |
|---|---|---|---|---|
| 1,093,637 | A * | 4/1914 | Lint | 292/172 |
| 1,218,065 | A * | 3/1917 | Diesel | 70/492 |
| 1,440,459 | A * | 1/1923 | Greff | 70/342 |
| 1,489,854 | A * | 4/1924 | Shinn | 70/492 |
| 1,567,701 | A * | 12/1925 | Briggs et al. | 70/367 |

(Continued)

FOREIGN PATENT DOCUMENTS

DE 44 12 609 10/1995

(Continued)

*Primary Examiner* — Lloyd Gall
(74) *Attorney, Agent, or Firm* — Lucas & Mercanti, LLP; Klaus P. Stoffel

(57) ABSTRACT

A locking device contains a locking cylinder with a freewheeling sleeve (11), cylinder core and tumblers (27). The cylinder core can be rotated by a matching key because the tumblers (27) which lock the cylinder core release the freewheeling sleeve (11) when the key is removed. The freewheeling sleeve (11) is mounted rotationally in a housing (18) and is fixed in a defined rotational position by a latching element in the housing (18), which latching element is loaded (34) radially by a spring element. Upon forcible rotations of the cylinder core, which characterize an overloading situation, the latching element releases the freewheeling sleeve (11). An output element which brings about the desired functions in the vehicle is also located in the housing, as is, furthermore, a coupling element which is rotationally fixed to the output element, is under a radial resetting force and can be displaced radially. In the normal situation, the coupling element is coupled to the cylinder core, but is decoupled in the overloading situation. For a reasonably priced, space-saving design, it is proposed to form the spring element and the latching element as a premanufactured, compact constructional unit (31, 32). The constructional unit (31, 32) is arranged in a chamber (25) of the housing (18) and forms an insert which is handled as one during installation and removal.

8 Claims, 6 Drawing Sheets

U.S. PATENT DOCUMENTS

| | | | | | |
|---|---|---|---|---|---|
| 1,657,039 | A | * | 1/1928 | Schafer | 70/492 |
| 3,555,859 | A | * | 1/1971 | Berkowitz | 70/340 |
| 3,648,493 | A | * | 3/1972 | Geisler | 70/375 |
| 4,324,121 | A | * | 4/1982 | Richter | 70/459 |
| 4,598,563 | A | * | 7/1986 | Berkowitz | 70/492 |
| 4,712,398 | A | * | 12/1987 | Clarkson et al. | 70/276 |
| 5,775,147 | A | | 7/1998 | Wittwer | |
| 6,439,016 | B1 | * | 8/2002 | Wittwer et al. | 70/379 R |
| 6,742,368 | B1 | * | 6/2004 | Wittwer et al. | 70/379 R |
| 7,536,887 | B2 | * | 5/2009 | Makino | 70/379 R |
| 7,854,153 | B2 | * | 12/2010 | Lennhoff et al. | 70/370 |

FOREIGN PATENT DOCUMENTS

| | | |
|---|---|---|
| DE | 199 59 833 | 5/2001 |
| DE | 101 27 705 | 2/2002 |
| EP | 0 520 904 | 12/1992 |
| EP | 0 643 183 | 3/1995 |

* cited by examiner

FIG. 2a
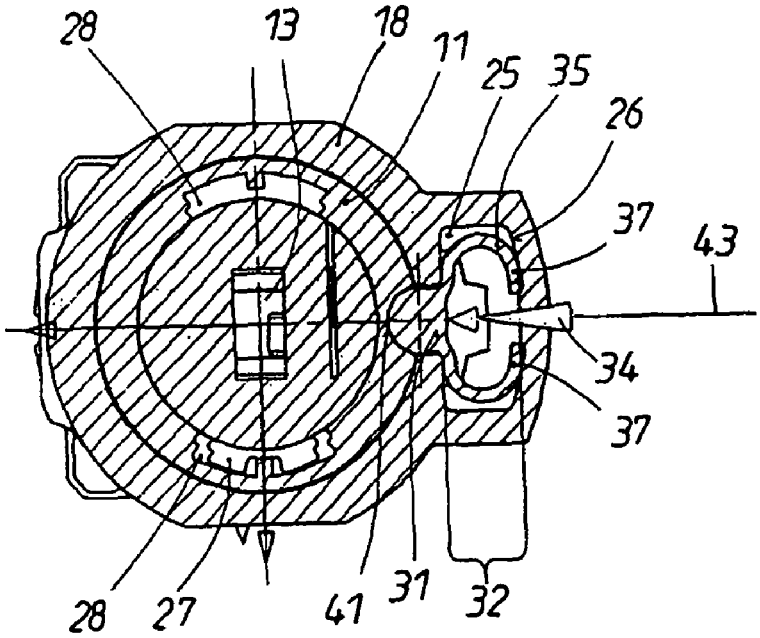
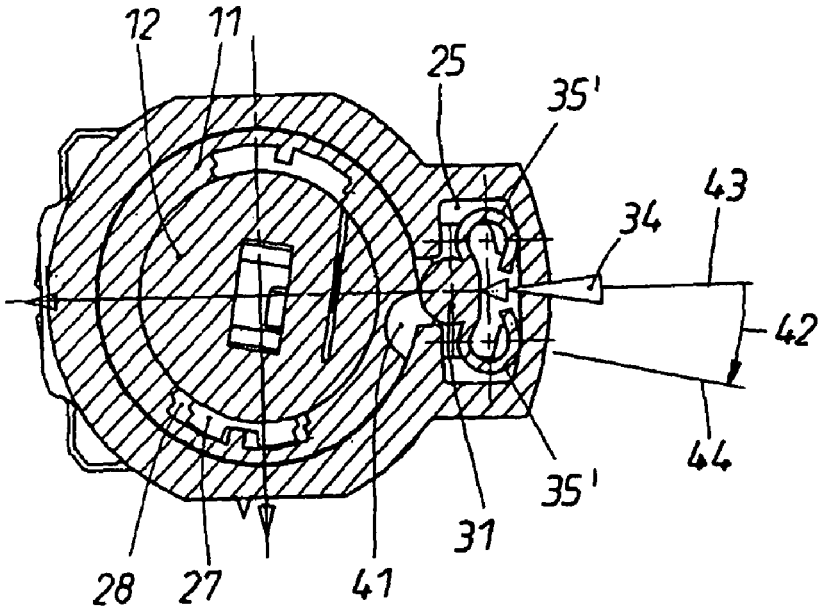
FIG. 2b

FIG. 3a
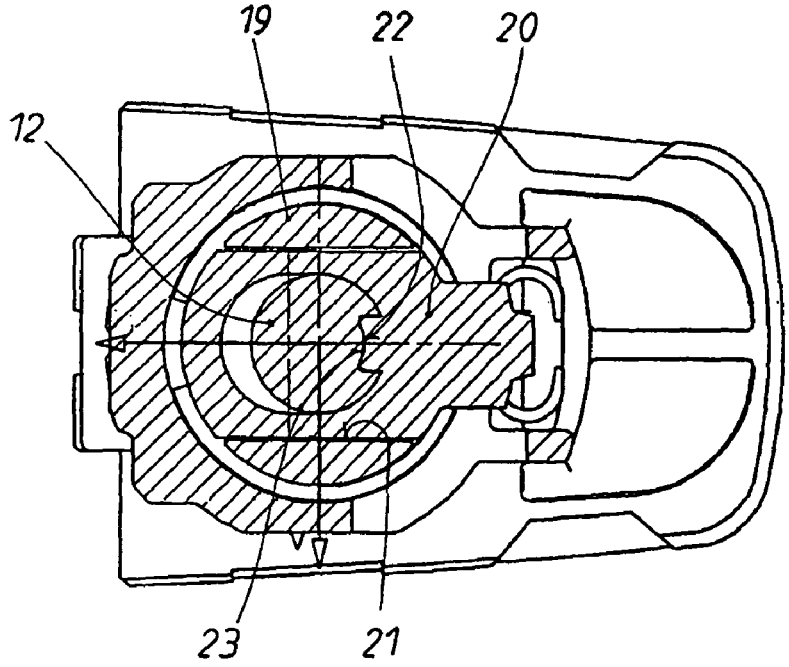
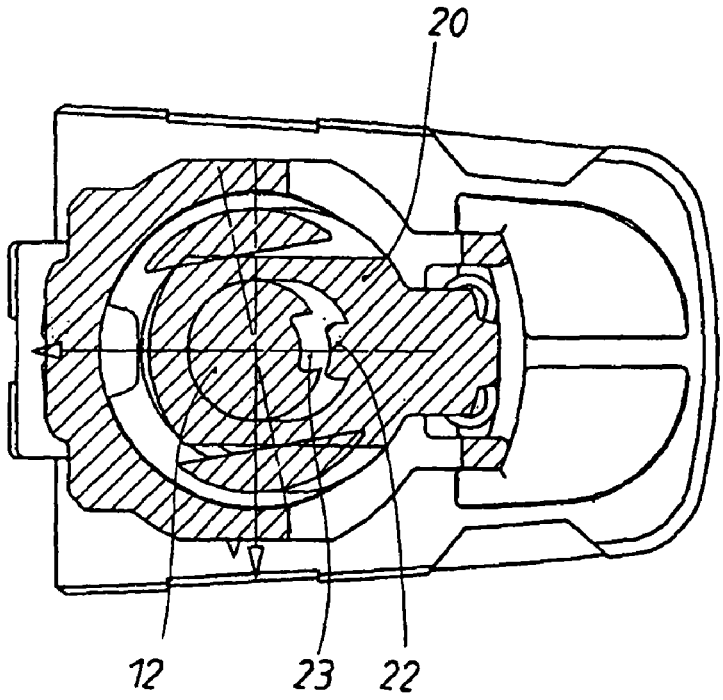
FIG. 3b

FIG. 4a
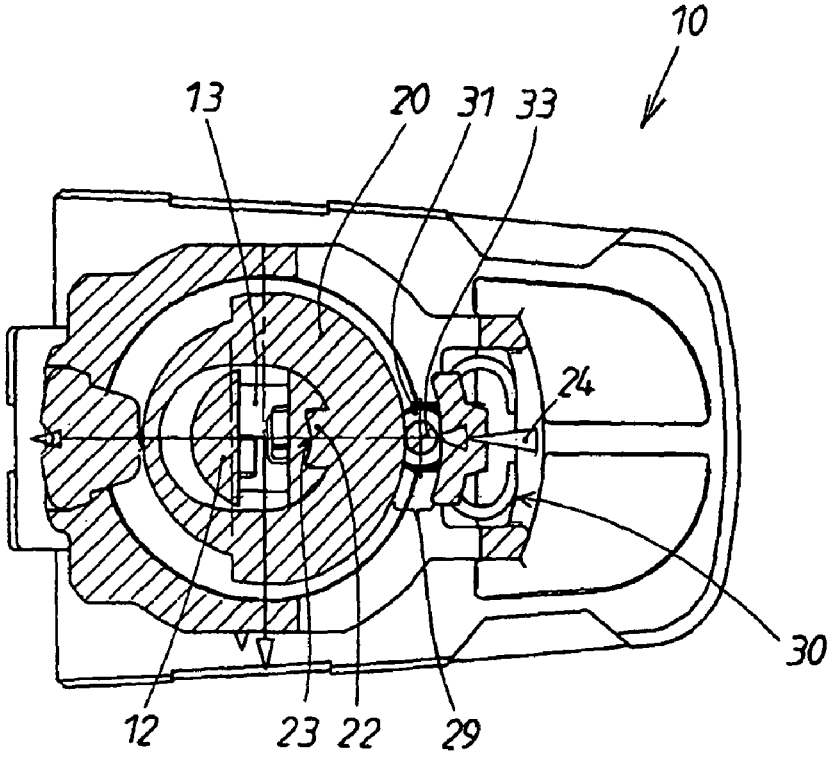
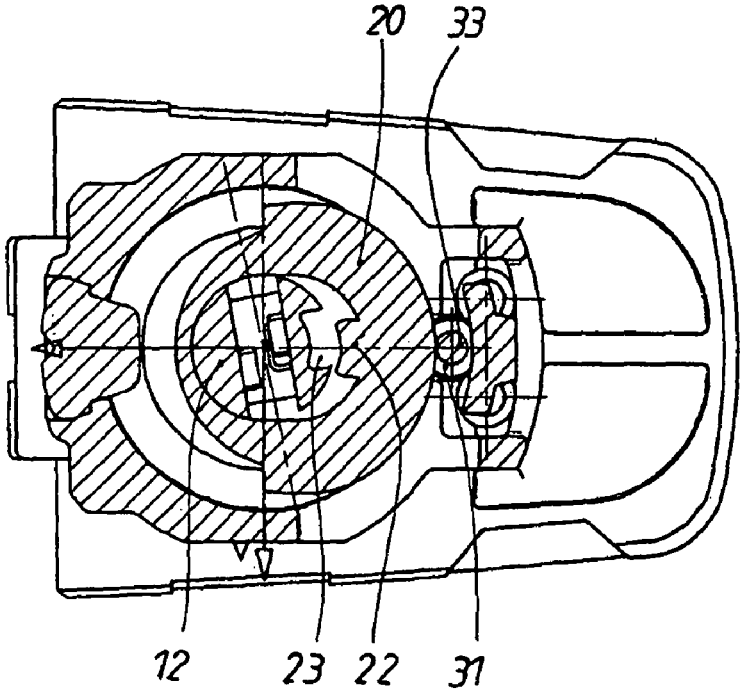
FIG. 4b

FIG. 5a
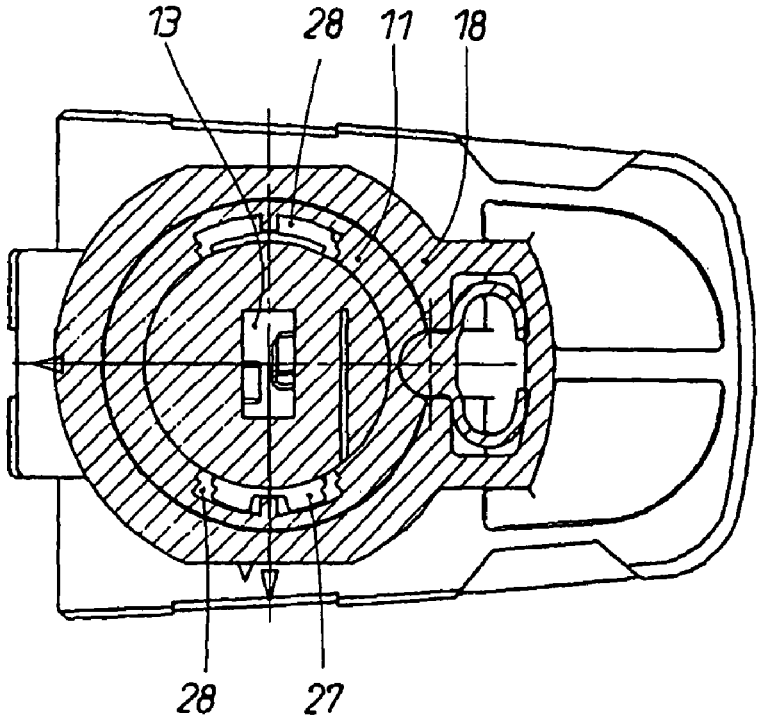
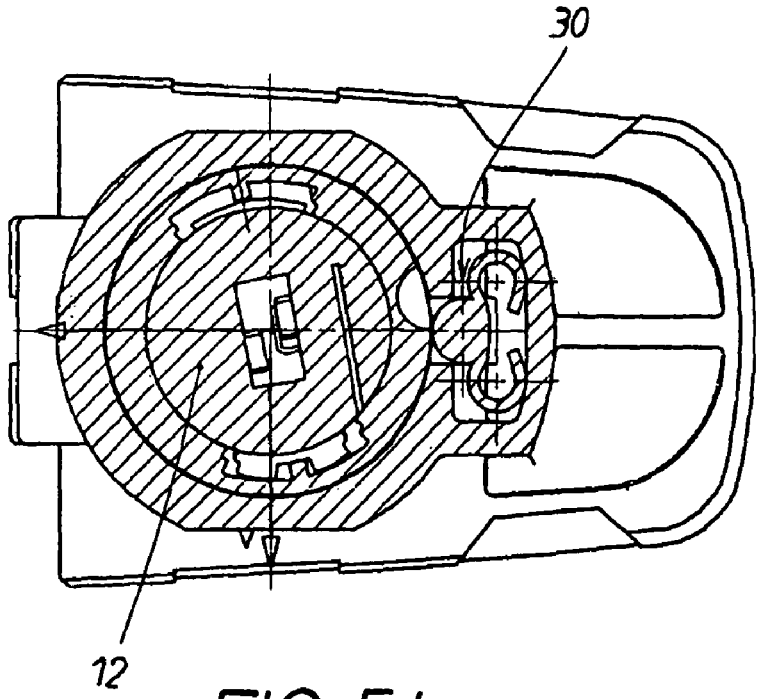
FIG. 5b

LOCKING DEVICE FOR FUNCTIONS WHICH CAN BE CARRIED OUT IN PARTICULAR ON VEHICLES

BACKGROUND OF THE INVENTION

The invention concerns a lock device. If the key that fits the cylinder core is fully inserted and then turned, rotation of the cylinder core is transmitted to an output element, which performs the desired functions in the vehicle, e.g., the locking or unlocking of a lock. In this case, the free-turning sleeve that rotatably supports the cylinder core is secured by a catch element; the "normal case" of the lock device is then present.

In the event of a forced rotation of the cylinder core by the use of lock-picking tools, the catch element releases the free-turning sleeve. The free-turning sleeve then turns in the housing together with the cylinder core connected by the tumblers without causing the output element to rotate in the housing. The "overload case" is then present. No functions in the vehicle are triggered.

DE 199 59 833 C1 discloses a lock device. In that case, the catch element is seated in a radial opening in the housing. In the vicinity of this radial opening, the housing has a circumferential groove, in which an annular spring is mounted. The annular spring, which is designed as a spiral coil and has several windings, encircles the circumference of the housing and exerts radial spring tension on the catch element. As a result, the catch element tries to hold the free-turning sleeve in a nonrotating position in the housing. The catch element and the annular spring consist of two separate parts, which must be separately produced and mounted. Besides the radial opening for the catch element, it is also necessary to provide the housing with a circumferential groove for the annular spring. During the radial movement of the catch element between the normal case and the overload case, the annular spring expands radially outward, so that this peripheral area of the housing must be kept free and therefore is no longer available for other important components. The annular spring takes up a great deal of space in the peripheral area of the housing.

DE 44 12 609 A1 discloses another lock device, in which a compression spring is mounted in its own chamber of an output element and generates a radial restoring force on a coupling element. The coupling element exerts spring tension on a catch element via axial shoulders, and the catch element rotationally fixes a free-turning sleeve in the housing. This lock device also occupies a great deal of space. Furthermore, the spring element, which operates through the coupling element, is mounted separately from the catch element.

SUMMARY OF THE INVENTION

The objective of the invention is to develop a lock device which is inexpensive, operates reliably, and saves space.

In the lock device of the invention, the spring element and the catch element form a complete prefabricated component, which is sufficiently compact that it can be mounted in a common chamber of the housing. The spring element and the catch element are permanently connected to each other. The component serves as an insert that can be handled as a whole during the assembly or disassembly of the lock device, which simplifies the assembly operation. The spring element and the catch element forming the component constitute a single joined piece.

The two elements of the component of the invention could be produced from different materials according to their functions. Thus, the component could be produced in a so-called two-plastic injection technique, in which the region of the component that forms the catch element is produced to be nondeformable, and the region that forms the spring element is produced from elastic material. Another possibility would be to construct the spring element from a spring steel sheet, on which the region of the component that forms the catch element is injected as a plastic material.

However, it is especially advantageous to produce the spring element and the catch element forming the component side by side as a single piece of the same material. This eliminates separate handling of the two elements during production and assembly. During their common production, e.g., by plastic injection molding, the complete insert is already present and then needs only to be inserted into the chamber.

Other measures and advantages of the invention are specified in the dependent claims and in the following description with reference to the drawings, which show a specific embodiment of the invention.

BRIEF DESCRIPTION OF THE DRAWINGS

The following FIGS. 2*a* to 5 show cross sections along the various sectional planes labeled II-II to V-V in FIG. 1, where FIGS. 2*a* to 5*a* illustrate the aforementioned normal case, which is present either with the key extracted or the key inserted before the rotation of the cylinder core. FIGS. 2*b* to 5*b*, on the other hand, show the analogous cross sections along the sectional planes labeled II-II to V-V in FIG. 1 when the aforementioned overload case is present. In the case of overload, lock-picking tools have caused the cylinder core, together with the free-turning sleeve that is nonrotatably connected via the projecting tumblers, to be rotated and thus disconnected from the output element.

FIGS. 2*a* and 2*b* show cross sections along sectional line II-II in FIG. 1 in the normal case and in the overload case.

FIGS. 3*a* and 3*b* show analogous cross sections along sectional line in FIG. 1.

FIGS. 4*a* and 4*b* show analogous cross sections along sectional line IV-IV in FIG. 1.

FIGS. 5*a* and 5*b* show analogous cross sections along sectional line V-V in FIG. 1.

Figure 6:
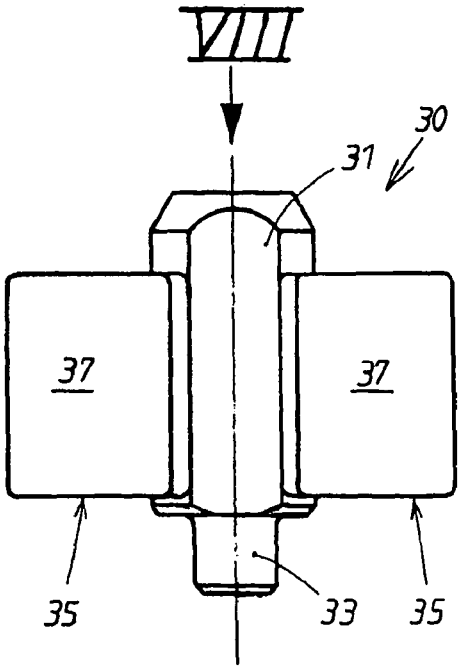
Figure 7:
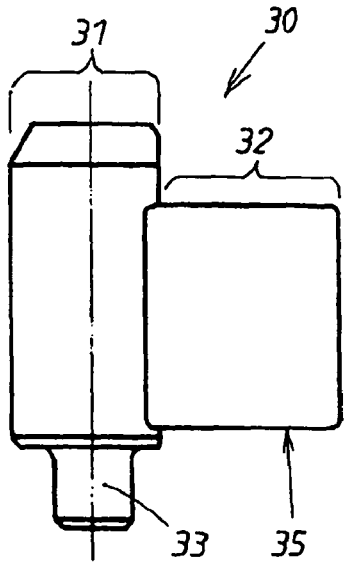
Figure 8:
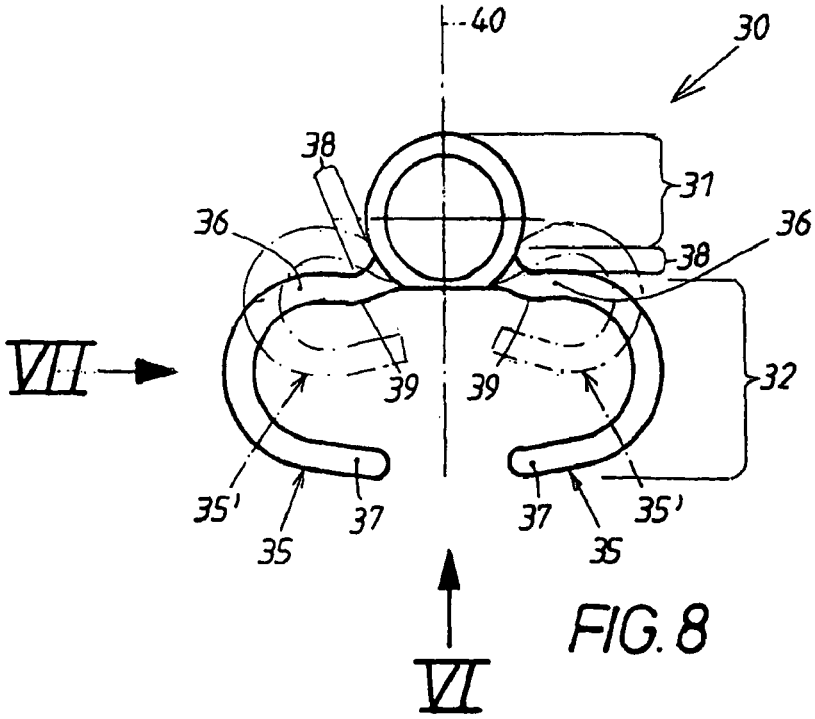

An important part of the lock device of the invention is shown greatly enlarged in FIGS. 6 to 8, namely, a one-piece component for the lock cylinder according to the invention, which consists of an inseparable combination of a catch element and a spring element.

FIG. 6 shows a rear view of the component, looking in the direction of arrow VI in FIG. 8.

FIG. 7 shows a side view of the component, looking in the direction of arrow VII in FIG. 8.

FIG. 8 shows a top view of the component, looking in the direction of arrow VIII in FIG. 6.

DETAILED DESCRIPTION OF THE INVENTION

The lock cylinder 10 comprises a free-turning sleeve 11 and a cylinder core 12 rotatably supported therein. An axial key slot 13 passes through the cylinder core. A key (not shown) that fits the slot must be inserted in the slot when the desired functions in the vehicle are to be carried out. When the key is inserted, the end of the key is inserted through a hole in an armored cap 14, the hole normally being closed by a spring-loaded keyhole cover 15. The key slot is provided with a plurality of transverse chambers 16 that pass through the key slot 13. Spring-loaded tumblers 17 are held in the chambers 16. The tumblers 17 have control shoulders of different heights, which provide for the corresponding movement of the tumblers when the key is inserted.

FIGS. 2*a* and 5*a* show two diametrically opposed blocking channels 28 of the free-turning sleeve 11. When the key is extracted, the ends 27 of the tumblers, which extend radially outward from the cylinder core 12, as can be seen in FIGS. 2*a* and 5*a*, engage in one or the other of the two blocking channels 28. The cylinder core 12 is then locked to the free-turning sleeve 11.

The lock cylinder 10 also includes a housing 18, which is installed in a position which remains stationary during use. The housing 18 serves to support the free-turning sleeve 11 so that it is free to rotate. An output element 19 is also supported in the housing 18. In the normal case, the output element 19 transmits the key-induced rotation of the cylinder core 12 to downstream elements (not shown in detail) outside of the housing 18 in a way that will be described in greater detail below, and these downstream elements then carry out the desired function. This occurs indirectly via a coupling element 20, which is seen best in FIG. 3*a*. The coupling element 20 is connected nonrotatably to the output element 19. In the present case, this occurs by means of a radial guide 21 of the coupling element 20 in the output element 19.

In the normal case, according to FIG. 3*a*, the coupling element 20 is connected to the cylinder core 12. For this purpose, the coupling element 20 has a projection 22, which fits into a recess 23 in the cylinder core 12. This coupling engagement can also be seen in FIG. 4*a*. The spring tension 24 indicated by an arrow in FIG. 4*a* produces the coupling engagement. This spring tension is generated by a special component 30. The appearance of this special component 30 is shown in magnified views in FIGS. 6 to 8.

In the present case, this unit is produced as a single piece from uniform material, namely, plastic. The unit can be divided into two functionally different sections 31, 32, which are described in greater detail below. During the assembly of the lock cylinder, the unit 30 is handled as a whole and is inserted in a chamber 25 of the housing 18. This is shown in FIGS. 1 and 2*a*.

Figure 1:
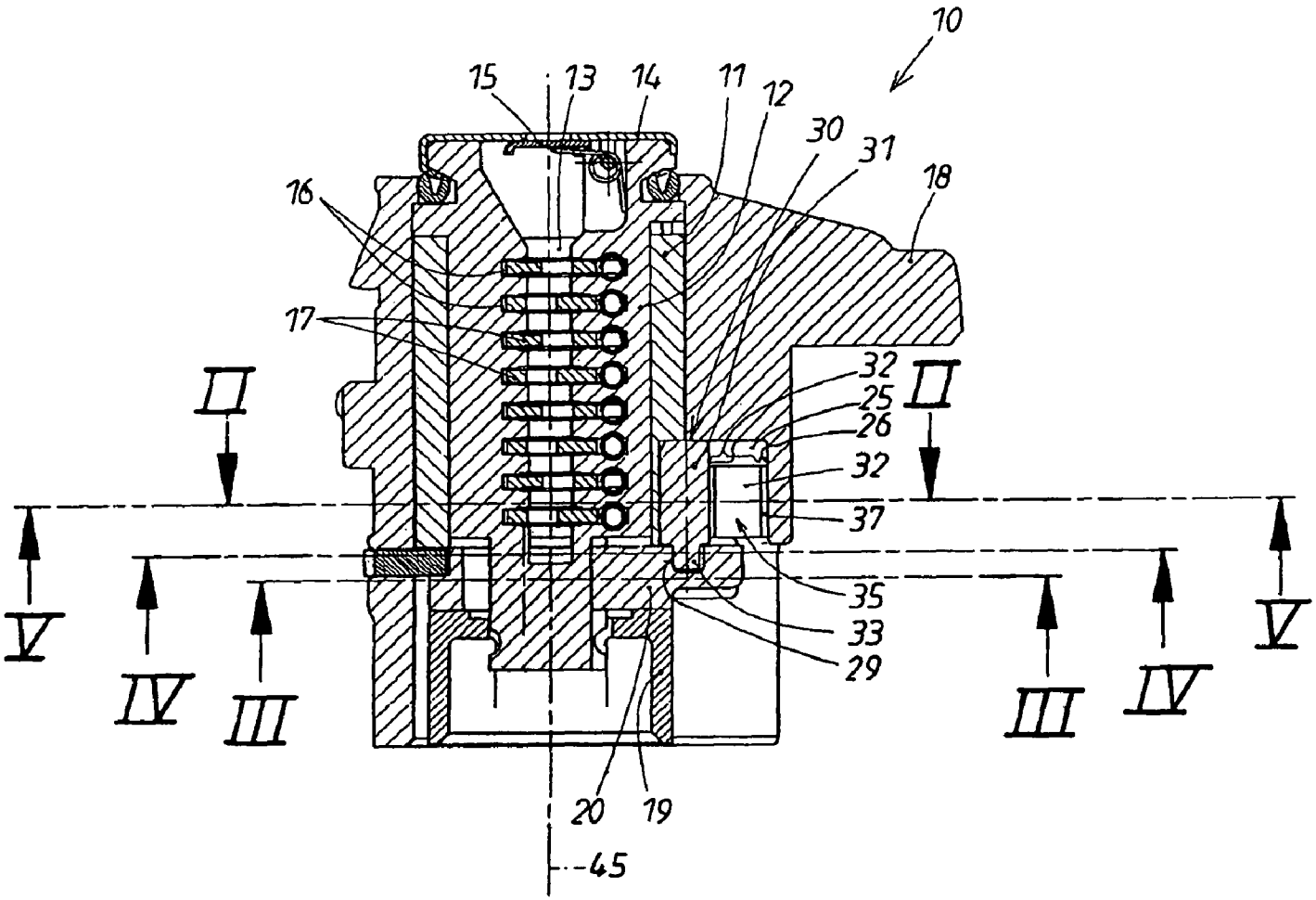
FIG. 1 shows an axial section through a lock cylinder of the lock device of the invention, with the associated key extracted.

In the assembled state according to FIG. 1 or 2*a*, the first section 31 lies on the inside and consists of a pin, which is essentially nondeformable and can be seen best in FIGS. 6 to 8. In the present case, this is accomplished by a concentration of material in this area 31. The pin 31 is designed as a cylinder and an axial journal 33, that fulfills the connecting functions in the lock cylinder 10. As FIG. 4*a* shows, the axial journal 33 engages in a recess 29 in the coupling element 20. In the normal case, the pin 31 fits into a catch receiver 41 (seen best in FIG. 2*b*) of the free-turning sleeve 11 and provides for its rotational fixation. This locked state is illustrated in FIG. 2*a*. This position of the pin 31 is brought about by the aforementioned other section 32.

The other, outer section 32 is designed as a flexible element, and in the assembled state it has the function of generating radial spring tension in the direction of arrow 34 in FIG. 2*a*. To this end, as FIGS. 1 and 2*a* show, this outer section 32 is supported on a shoulder 26 in the housing 18. In the present case, the shoulder 26 consists of an inner wall of the chamber 25. The actual construction of this flexible outer section 32 is also apparent from FIGS. 6 to 8.

In the present case, the flexibility of the outer section 32 is produced by the U-shaped leaf springs 35. First, two radial extensions 38 proceed from the cylindrical surface of the pin 31. The inner sidepieces 36 of the U-shaped leaf springs 35 act on these extensions 38. At the transition between the radial extensions 38 and the inner sidepieces 36, there are small bends 39. The two U-shaped leaf springs 35 are symmetric with respect to a central plane of symmetry 40 passing through the axis of the cylindrical pin 31. The ends of the two outer sidepieces 37 are thus directed toward each other.

In the assembled state as shown in FIGS. 1 and 2*a*, the two outer sections 37 are supported on the shoulder 26 of the housing chamber 25, and are deformed in their U-shaped profile. The two leaf springs 35 are already pretensioned in the normal case, as indicated in FIG. 2*a* by the auxiliary line 43. This gives rise to the aforementioned spring tension 34 shown in FIG. 2*a*, which tries to bring the pin 31 into engagement with the catch receiver 41 in the free-turning sleeve 11. At the same time, however, this spring tension 34 acts on the coupling element 20 in the following way.

As was mentioned earlier in connection with FIG. 4*a* and as can be seen in FIG. 1, the aforementioned axial journal 33 of the pin 31 fits into a recess 29 in the coupling element 20 and can be moved radially together with the coupling element 20. This has the effect that the previously described spring tension 34 of the pin 31 also acts on the coupling element 20 and generates the axial restoring force 24 already been described in connection with FIG. 4*a*. The U-shaped leaf springs 35 thus have the dual function of providing for the catch engagement of the pin 31 in the catch receiver 41 of the free-turning sleeve 11 and of producing the coupling engagement between the coupling element 20 and the cylinder core 12 at 22, 23.

The conditions described above are present when the "normal case", which has already been mentioned several times, is present. As was mentioned earlier, the rotational position of the catch receiver 41 of the free-turning sleeve 11 is marked in FIG. 2*a* by an auxiliary line 43, which indicates the "normal case". This auxiliary line 43 is also drawn in FIG. 2*b*. This situation, however, changes in the "overload case", which occurs when unauthorized individuals attempt to turn the cylinder core 12 with lock-picking tools. As was previously described, the tumblers 17, the ends 27 of which project from the cylinder core 12 and which are positioned in the blocking channels 28 of the free-turning sleeve 11, ensure that the two components 11, 12 are locked together and rotate together during a forced rotation. FIG. 2*b* shows what occurs in the first phase of this forced rotation.

A lock-picking tool (not shown) has been used to turn the free-turning sleeve 11 the rotational distance 42 indicated in FIG. 2*b*. The catch receiver 41 is now located in a rotational position marked by an auxiliary line 44. A well-defined limit torque has been exceeded by turning the lock-picking tools, with the result that, because of the shape of the pin 31 and the mating shape of the catch receiver 41, the pin has been pushed out against its spring tension 34 in the direction of the chamber 25. The U-shape of the leaf springs 35 has been deformed; the outer sidepiece 37 has been deformed in the direction of the inner sidepiece 36. The leaf spring assumes the shape shown in FIG. 8 as a dot-dash line, which is designated as U-shape 35'. This can also be seen in FIG. 2*b*. The "overload case", which has already been mentioned several times, is thus present in the rotational position of the free-turning sleeve 11 indicated by the auxiliary line 44.

Since, as has already been explained in connection with FIG. 4*a*, the pin 31 is connected by its axial journal 33 to the coupling element 20, as FIG. 4*b* shows, the coupling element 20 is also moved away from the cylinder axis 45 indicated by a dot-dash line in FIG. 1. The result is that projection 22 of the coupling element 20 becomes disconnected from the recess 23 in the cylinder core 11. This can be seen in FIG. 3*b*. The result is that in the overload case 44, the cylinder core 11 is disconnected from the coupling element 20 and therefore is not carried along during the forced rotation. Because the coupling element 20 is not rotated with the cylinder core 12, the output member 19 is not turned either. Consequently, during an overload, the output member 19 does not transmit any rotation to the downstream elements of the lock device, and therefore no functions are initiated in the vehicle.

LIST OF REFERENCE NUMBERS

10 lock cylinder
11 free-turning sleeve
12 cylinder core
13 key slot
14 armored cap
15 keyhole cover
16 chamber for 17 in 12
17 tumbler in 16
18 housing of 10
19 output element of 10
20 coupling element in 18
21 radial guide of 19 for 20 (FIG. 3*a*)
22 projection of 20 (FIG. 3*a*)
23 recess in 12 (FIG. 3*a*)
24 arrow of the restoring force for 20 (FIG. 4*a*)
25 chamber in 18 (FIGS. 1, 2*a*)
26 shoulder of 18 for 32, inner wall of 25 (FIGS. 1, 2*a*)
27 end of 13 (FIG. 2*a*)
28 blocking channel of 27 in 11 (FIG. 2*a*)
29 recess in 20 for 33 (FIG. 4*a*)
30 component (FIGS. 6 to 8)
31 inner section of 30, pin
32 outer section of 30, flexible element (FIGS. 7 and 8)
33 connection between 31 and 20, axial journal on 31 (FIGS. 6, 7)
34 arrow of spring force for 31 (FIG. 2*a*)
35 U-shaped leaf spring in the normal case (FIG. 8)
35' deformed U-shape of 35 in the overload case (FIGS. 2*b*, 8)
36 inner sidepiece of 35 (FIG. 8)
37 outer sidepiece of 35 (FIG. 8)
38 radial extension on 31 (FIG. 8)
39 small bend between 37, 38 (FIG. 8)
40 plane of symmetry for 35 (FIG. 8)
41 catch receiver for 31 (FIG. 2*a*)
42 rotational distance of a forced rotation of 11 (FIG. 2*B*)
43 auxiliary line for the normal case of 11 (FIG. 2*a*)
44 auxiliary line for the overload case of 11 (FIG. 2*b*)
45 axis of 10 (FIG. 1)

The invention claimed is:

1. A lock device for functions that can be performed in vehicles, comprising:

a lock cylinder (10), which consists of a free-turning sleeve (11) and a cylinder core (12) with tumblers (17), the core being rotatably supported in the sleeve;

a key which fits the cylinder core (12) and which, in a normal case (43) when inserted, controls the tumblers (17), and, after the key is removed, the tumblers (17) lock the cylinder core (12) to the free-turning sleeve (11);

a stationary housing (18) for rotatably supporting the free-turning sleeve (11), an output element (19), which is rotatably supported in the housing (18) and performs the functions in the vehicle by its rotation;

a prefabricated component (30) made up of two functionally different sections (31, 32), one section being a non-deformable pin (31) and another section being a flexible element (32);

the component (30) being handleable as a whole and forming an insert in the housing (18);

the housing (18) having an axially open chamber (25) laterally adjacent the free-turning sleeve (11), the component (30) being insertable into an interior of the chamber (25) via a chamber opening, the flexible element (32) of the component (30) being supported on an inner wall (26) of the chamber (25), while the pin (31) is under spring tension (34) radially against the free-turning sleeve (11);

the pin (31) being radially movable in the housing (18) and in the normal case (43) rotationally holds the free-turning sleeve (11) in the housing (18) but releases the free-turning sleeve (11) in an overload case (44) in which the cylinder core (12) is forcibly turned;

a coupling element (20) that at least partially covers the axial opening of the chamber (25) so as to secure the inserted portion of the component (30) in the chamber (25) of the housing (18);

wherein the coupling element (20) is radially slideable relative to the cylinder core. (12) and is coupled with the cylinder core (12) in the normal case (43) of the free-turning sleeve (11), and is uncoupled in the overload case (44);

the coupling element (20) being nonrotatably connected to the output element (19);

wherein an axial connection (33) between the coupling element (20) and the pin (31) of the component (30) provides a joint radial movement of the pin (31) with the coupling element (20); and wherein the radial spring tension (34) of the element (32) of the component (30) simultaneously generates a radial restorin force of the coupling element (20) via the connection (33).

2. A lock device according to claim 1, wherein the sections forming the component (30) are made out of a single piece of uniform material.

3. A lock device according to claim 1, wherein the nondeformable pin (31) has a cylindrical design, whereas the flexible element (32) consists of at least one leaf spring (35).

4. A lock device according to claim 3, wherein the at least one leaf spring (35) is essentially U-shaped, where an inner sidepiece (36) of the at least one U-shaped leaf spring (35) is supported on the pin (31), while an outer sidepiece (37), in its mounted state, is supported on the inner wall (26) in the housing (18), and where spring loading (34) of the pin (31) is produced by a deformation (35') of the at least one U-shaped spring.

5. A lock device according to claim 3, wherein a pair of leaf springs (35) is supported on the pin (31), with one leaf spring (35) being formed symmetrically to the other leaf spring (35).

6. A lock device according to claim 4, wherein a radial extension (38) proceeds from a cylindrical surface of the pin (31), and where the inner sidepiece (36) of the at least one U-shaped leaf spring (35) proceeds from the radial extension (38).

7. A lock device according to claim 6, wherein a small bend (39) is provided at the transition between the inner sidepiece (36) of the at least one U-shaped leaf spring (35) and the radial extension (38) of the pin (31).

8. A lock device according to claim 1, wherein the entire component (30) is made of plastic.

* * * * *